US009981775B2

(12) United States Patent
Kinaya et al.

(10) Patent No.: US 9,981,775 B2
(45) **Date of Patent: *May 29, 2018**

(54) ADJUSTABLE BASE DEVICE, SYSTEM AND METHOD OF USE

(71) Applicants: Christopher Anthony Kinaya, West Bloomfield, MI (US); Patrick Kinaya, West Bloomfield, MI (US); Matthew Kinaya, West Bloomfield, MI (US)

(72) Inventors: Christopher Anthony Kinaya, West Bloomfield, MI (US); Patrick Kinaya, West Bloomfield, MI (US); Matthew Kinaya, West Bloomfield, MI (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/480,795

(22) Filed: Apr. 6, 2017

(65) Prior Publication Data

US 2017/0210543 A1 Jul. 27, 2017

Related U.S. Application Data

(63) Continuation-in-part of application No. 14/487,339, filed on Sep. 16, 2014, now Pat. No. 9,643,753.

(51) Int. Cl.

| | |
|---|---|
| ***B65D 25/24*** | (2006.01) |
| ***B65D 21/08*** | (2006.01) |
| ***A47G 19/30*** | (2006.01) |

(52) U.S. Cl.

CPC ..... *B65D 21/08* (2013.01); *A47G 19/30* (2013.01)

(58) Field of Classification Search

CPC ..... B65D 83/0027; B65D 83/0005

See application file for complete search history.

(56) References Cited

U.S. PATENT DOCUMENTS

| | | | | |
|---|---|---|---|---|
| 5,513,770 A * | 5/1996 | Seeley | A47J 47/18 | 215/330 |
| 8,556,106 B1 * | 10/2013 | Bayat | B65D 43/0229 | 220/254.8 |
| 2008/0149661 A1 * | 6/2008 | Sines | B65D 21/08 | 221/279 |
| 2016/0075474 A1 * | 3/2016 | Kinaya | A47G 19/30 | 206/507 |

* cited by examiner

*Primary Examiner* — Andrew T Kirsch
*Assistant Examiner* — Don M Anderson
(74) *Attorney, Agent, or Firm* — Kohn & Associates, PLLC

(57) ABSTRACT

An adjustable base container including a first surrounding wall forming a hollow internal space therein, the first surrounding wall having an inner surface including threads lengthwise and a male pattern design on a top portion of the inner surface, a second surrounding wall fitting within the first surrounding wall having one or more slit openings along its length extending completely through a bottom end in an axial direction, and having a female pattern design on a bottom side of a top end, the female pattern design corresponding to and fitting over the male pattern design of the first surrounding wall, and a platform sitting within the second surrounding wall having a top and bottom surface, a central space, and protrusions extending laterally from a rim edge, the protrusions engaging with the inner surface of the first surrounding wall between the threads. A method of using the adjustable base container.

10 Claims, 8 Drawing Sheets

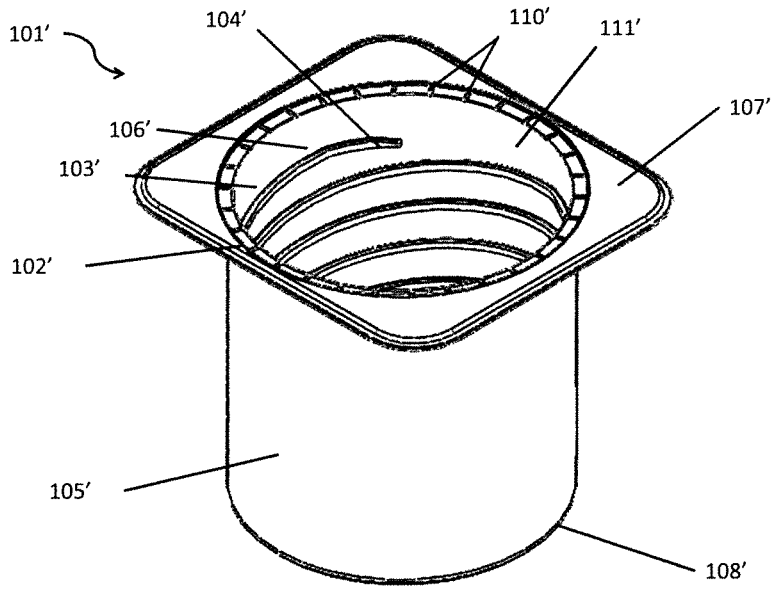
FIGURE 5
FIGURE 6
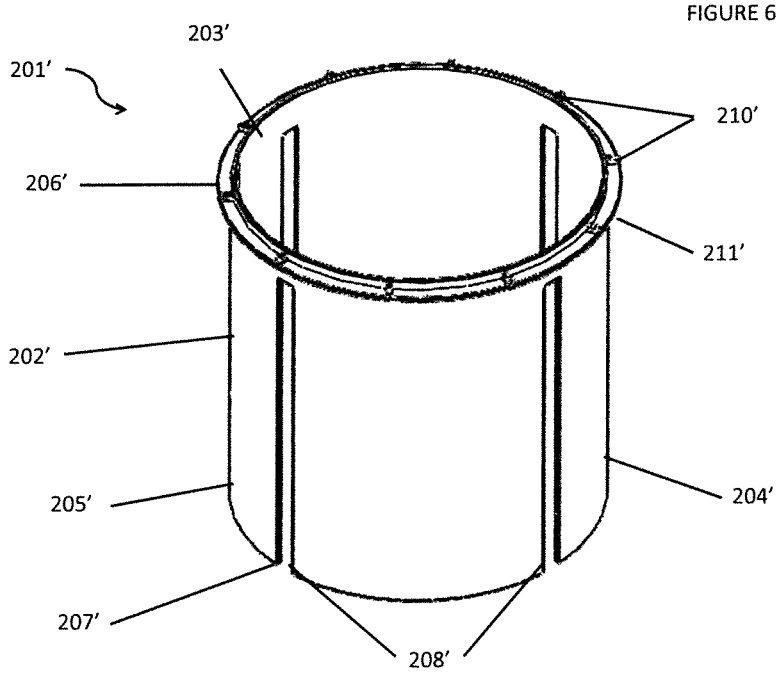

ADJUSTABLE BASE DEVICE, SYSTEM AND METHOD OF USE

BACKGROUND OF THE INVENTION

1. Technical Field

The present invention relates to an adjustable base device and system, particularly a device and system wherein a base is raised and lowered by rotating key means.

2. Background Art

Serving containers, particularly those containing prepared food in public view, should consider public perception of the products contained therein. Containers of this type interfacing in a public way are often found in open kitchen style restaurants or in intimate domestic settings. Open kitchen style restaurants, such as sandwich shops, buffet and self serve restaurants derive commercial value and sales from public perception of food presentation. Not only is a fresh presentation critical to the viability of such an establishment, it is also subject to regulation. In private use, when entertaining guests, food presentation is equally important. The desire of a guest or invitee to purchase or consume food held within an open container will depend on their perception of the quality and freshness of that food. As such, the aesthetic presentation of products held within an open container is a necessary quality and feature of an affective container device and system.

An existing and unsolved problem in the industry regards the fluctuation of volume in a given food container and how that may drive or detract from a perception of quality. The typical container used in establishments such as sandwich shops or bars are simply square or rectangular in shape with no adjustable base feature. As food is being depleted from a container, the food assembler or restaurant server would have to continually replenish the container with new material in order to create a perception of fullness and freshness. Any gap between refill leaves the container looking partially full or near empty. If the time between refill is extensive, the food held within will begin to look aged even if it is still edible. Poor perception negatively impacts and drives down sales, pushing away potential customers. When this problem becomes a consistent pattern for a business, it begins to impact reputation in irreversible ways. There is a need in the industry to enable restaurant staff to manage the fill perception of a container in public view in order to maintain the attention of their guests, consistency in presentation and standard of their reputation.

The prior art addressing this specific issue are few and inadequate. Those devices that allow a user to adjust perception of volume without continual refill typically provide a container with a floating base centrally attached to a stem or handle. The handle tends to be embodied in a vertical stick protruding from or through the center of the floating base, interconnecting with the base and causing both elements to move together. The stick protrudes sufficiently upward or outward from the container to be accessible by the user's hand. Lifting the base would require the user to pull the handle upward, raising the handle and the floating base. Although the base is effectively lifted, so is the stem further above the top of the container. The stem being attached centrally to the base detracts from usable surface area of the base, affecting the way in which and the amount of material held therein. An alternative embodiment would have the stem protruding from the side of the container. However, this would result in a vertical slit through the container, eliminating the ability for the container to hold flowable material. In this case, the slidable stem to the side of the container not only takes away usable space from the side perimeter of the container, but also is difficult to access if the container is placed adjacent to other products. As such, the concept of a floating adjustable base that is moved by an attached stem or handle is not a practical solution to the problem highlighted herein.

There is currently no container having a vertically adjustable base that provides an illusion of continual fullness, with maximum usable surface area on the base, is easy to handle, satisfies FDA sanitary regulation, and has no above surface protrusion that would otherwise impede or detract from the work area.

SUMMARY OF THE INVENTION

The present invention provides for an adjustable base container including a first surrounding wall forming a hollow internal space therein, the first surrounding wall having an inner surface including threads lengthwise and a male pattern design on a top portion of the inner surface, a second surrounding wall fitting within the first surrounding wall having one or more slit openings along its length extending completely through a bottom end in an axial direction, and having a female pattern design on a bottom side of a top end, the female pattern design corresponding to and fitting over the male pattern design of the first surrounding wall, and a platform sitting within the second surrounding wall having a top and bottom surface, a central space, and protrusions extending laterally from a rim edge, the protrusions engaging with the inner surface of the first surrounding wall between the threads.

The present invention also provides for a method of using an adjustable base container, by rotating a second surrounding wall in a first direction relative to a first surrounding wall, moving at least one slit opening of said second surrounding wall in the first direction, moving at least one protrusion on a platform in a first direction along a threaded inner surface of the first surrounding wall, thereby raising or lowering the platform, and stabilizing the second surrounding wall on the first surrounding wall.

DESCRIPTION OF THE DRAWINGS

Other advantages of the present invention are readily appreciated as the same becomes better understood by reference to the following detailed description when considered in connection with the accompanying drawings wherein:

FIG. 5 is a side perspective view of an alternative embodiment of a first surrounding wall;

FIG. 6 is a side perspective view of an alternative embodiment of a second surrounding side wall;

DETAILED DESCRIPTION OF THE INVENTION

Figure 2:
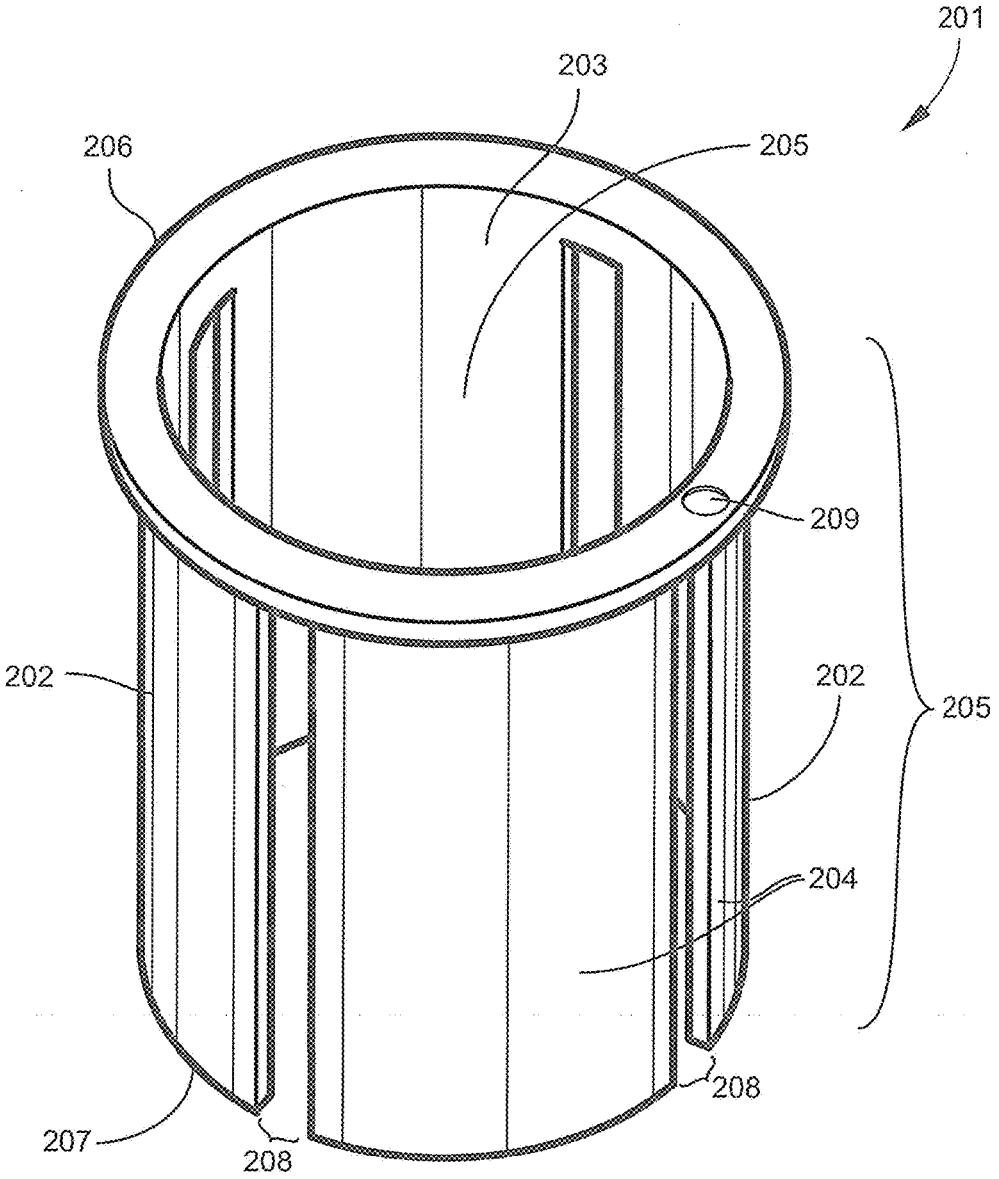
FIG. 2 is a side perspective view of an exemplary embodiment of a second surrounding side wall.
Figure 3:
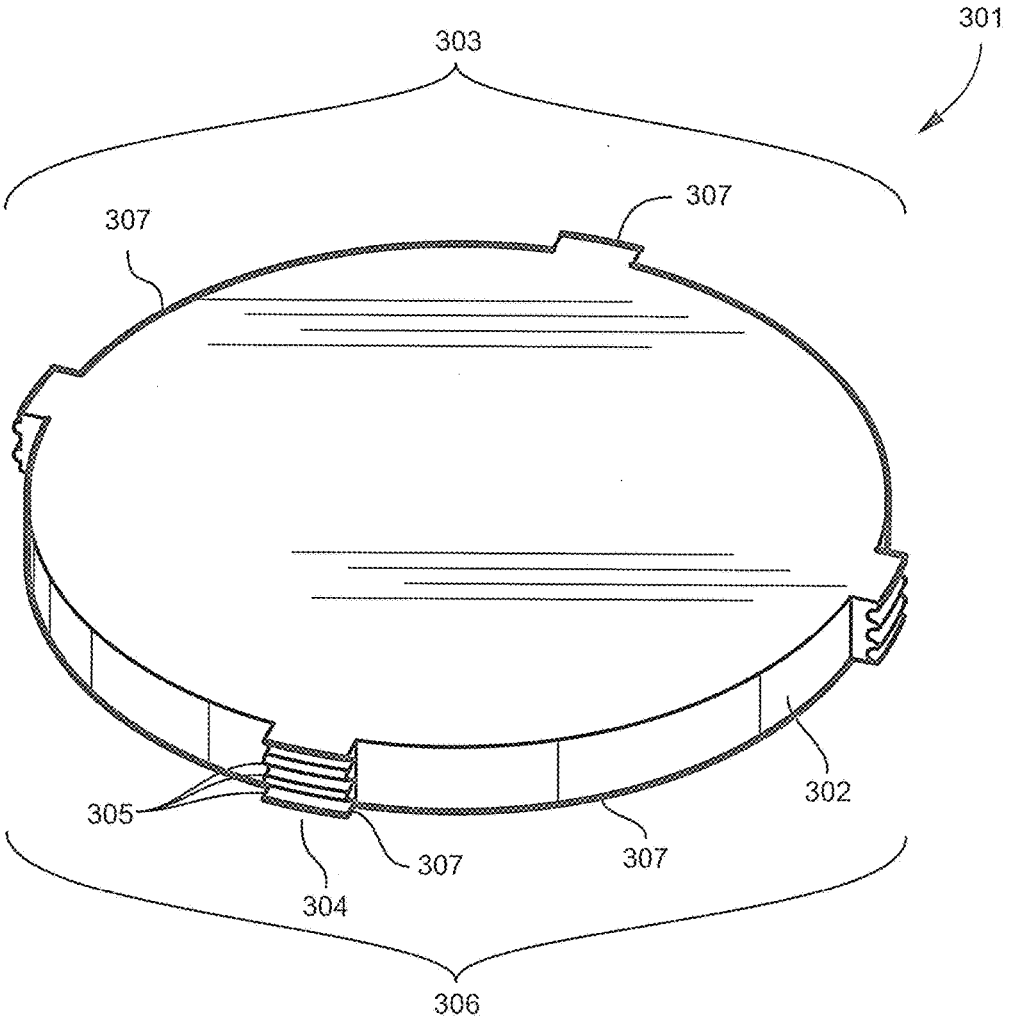
FIG. 3 is a top perspective view of an exemplary embodiment of a platform.
Figure 4:
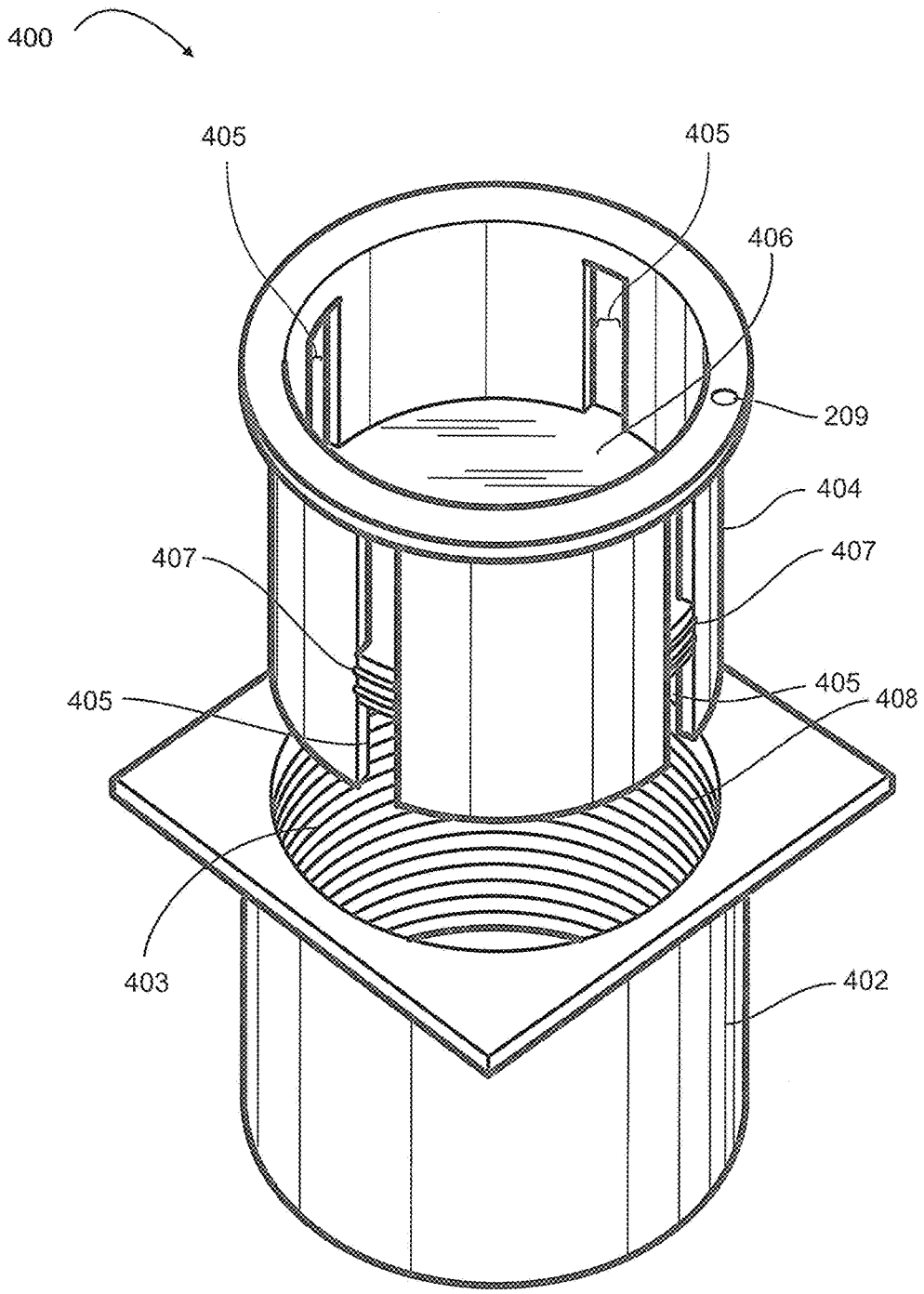
FIG. 4 is a side perspective of an exemplary embodiment of the invention herein.

The invention herein relates to a container device and system, shown at 400 in FIG. 4, with an adjustable base and a method of adjusting the base within the container. The device includes the following core elements: a hollow container 101 (FIG. 1), a platform 301 (FIG. 3), and a rotating key 201 (FIG. 2). Primed numbers indicate like structure amongst the several embodiments.

Figure 1:
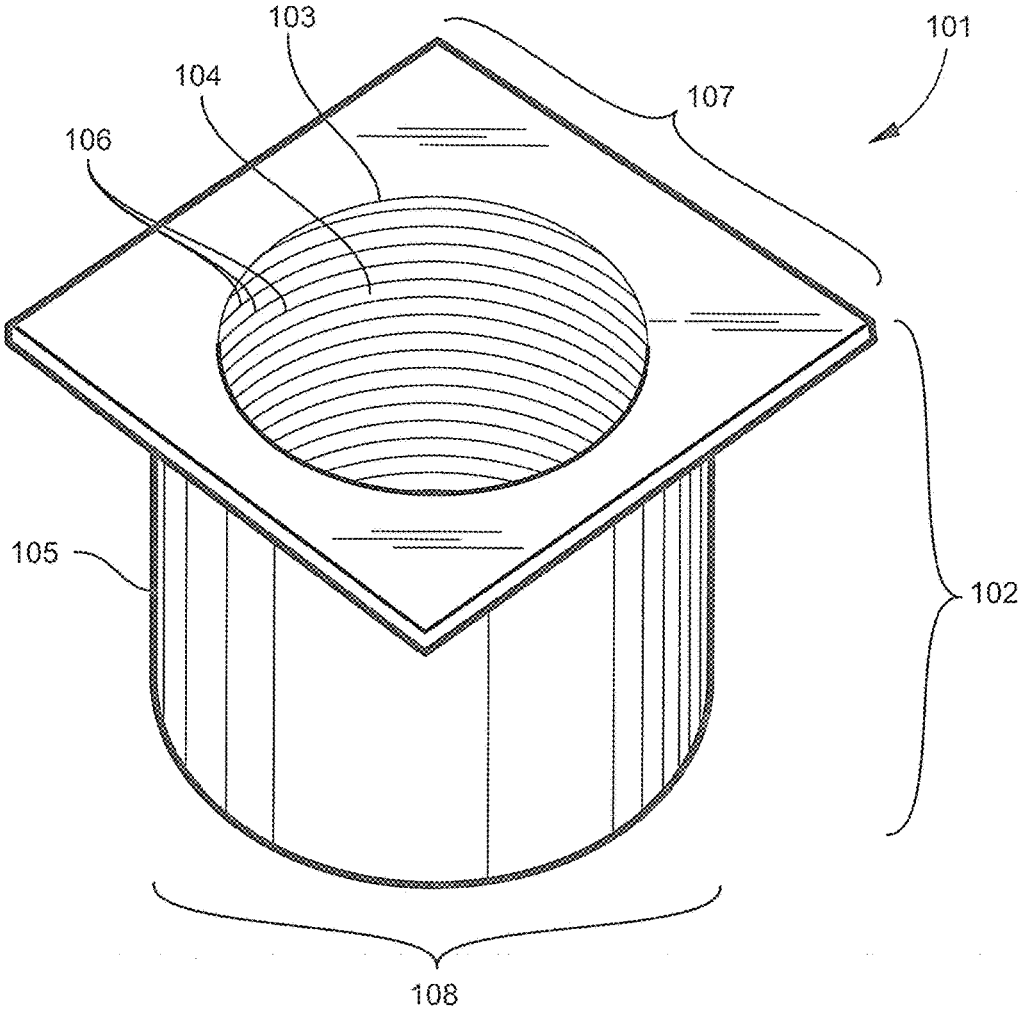
FIG. 1 is a side perspective view of an exemplary embodiment of a first surrounding side wall.

The hollow container 101, as shown in FIG. 1, is essentially one or more first surrounding walls 101 defining a hollow space or cavity within (104). The first surrounding wall 101 according to this generalized embodiment is cylindrical in shape along its hollow column 102. However, it need not necessarily be cylindrical to function according to the method and system described herein. The first surrounding wall 101 has an inner surface 103 facing the hollow inner cavity 104 and an outer surface 105 facing the external ambient environment. The inner surface 104 is threaded 106 around its perimeter extending lengthwise along the column 102 to allow upward and downward rotation along the length of the column 102. The threading can be wide or narrow, depending on the speed and fine adjustment of movement sought to be achieved. The first surrounding wall 101 includes a top end 107 extending outward from the hollow column 102 forming a square lip and a bottom end 108 which can optionally be capped. The first surrounding wall 101 essentially forms a hollow tube with inner threading.

The first surrounding wall 101 is not limited to a cylindrical shape. It can easily be square, rectangular, triangular, etc. The important function of this piece requires a surrounding wall in the form of a column of tube having an internal surface that is threaded in a rotational manner at its cross section and lengthwise to allow threaded movement to travel along the length of the column.

The rotating key is embodied in the form of a second surrounding wall 201, shown in FIG. 2. The second surrounding wall 201 includes an enclosed wall surface 202. The wall surface 202 of the second surrounding wall 201 includes an inner surface 203 and an outer surface 204. The second surrounding wall 201 forms a hollow cavity column 205 with a top end 206 and a bottom end 207. The top end 206 and bottom end 207 can be capped although not necessarily so to be functional. The second surrounding wall 201 includes at least one or more slit openings 208 along its length 205 to accommodate the protrusion of the platform. According to this embodiment, the slit openings 208 are cut and slit all the way through the bottom end 207 (completely through the bottom end 207 in an axial direction) of the second surrounding wall 201. An alternative embodiment can have the platform and protrusion sleeved through the slit openings 208 but permanently maintained therein where the slit opening 208 is not cut all the way through to the bottom end 207 of the second surrounding wall 201. This can be helpful to prevent the platform from traveling past the very bottom end 207 of the container if so desired. It would also eliminate an extra step of assembly in that the second surrounding wall 201 containing the platform, being preassembled together as a unit, would be positioned over and rotated onto the first surrounding wall as the initial and only step of assembly. The drawback of this alternative embodiment is the introduction of hidden unexposed surfaces affecting FDA approval.

Yet another embodiment of the slit opening 208 can provide for multiple slit openings 208 of varying lengths of said opening along the second cylinder wall 201. Where the device comprises a cylindrical shaped first and second surrounding wall such that only one protrusion from the platform is necessary to enable this embodiment, the various lengths of slit openings 208 serves as optional key features that determine and limited the distance of travel by the platform 301 along the length of a tube without need for guessing by a user. The user would sleeve their choice length of slit opening 208 over the protrusion for a desired effect.

An accessory element introduced in FIG. 2 is a small groove 209 embedded at the top end 206 of the second surrounding wall 201 according this embodiment to allow a person's finger to be comfortably placed therein and to push the second surrounding wall 201 in a dialing motion towards a clockwise or counterclockwise direction. This groove 209 serves as lever assistance for ergonomic ease. The lever feature 209 is not necessary for the function of this device, system and method so long as the user is able to dial the second surrounding wall 201 while it is nested within the container system. The lever feature 209 is helpful to enable a better manual leverage and grip. It could alternatively take the form of a wrap around traction grip, a small protrusion or a molded handle. Even more, the rotational movement of the second surrounding wall 201 can be automated by mechanized means according to known methods in the art.

The rotating key element (second surrounding wall 201) itself need not be circular in form so long as it fits within the internal cavity of the first surrounding wall 101, rotate in a circular pattern within the wall, and where one or more protrusion 304 (described below) extends far enough outward to enable the platform to be in continual contact with the threading of the first surrounding wall 101. Where the two surrounding walls are not cylindrical in shape (i.e. square, triangular, etc.), more than one protrusion 304 may be required wherein each protrusion 304 having a different length to accommodate the nonsymmetrical distances between the protrusion 304 and the first surrounding wall 101 as the platform is being rotated. In this embodiment, each protrusion 304 would be in contact with the threading of the first surrounding wall 101 part of the time, but the platform 303 would always be in contact with the threading of the first surrounding wall 101 with anyone protrusion 304 all of the time.

The platform 301, shown in FIG. 3, includes a planar piece of material 302 having a top and bottom surface, a central area 303, a rim edge 306 and one or more protrusions 304. The ends of the protrusions 304 are threaded 305 to match and interlock with the threading of the first surrounding wall 101. The rim edge 306 of the platform 301 includes the outer most edge 307 of the platform including the protrusion 304. The slit opening 208 of the second surrounding wall 201 is sleeved over each protrusion 304 such that the surrounding side surface at each protrusion 304 interconnects with the internal surface 104 of the first surrounding wall 101 by their respective threading. The second surrounding wall 201 is nested between the first surrounding wall 101 and the platform 301 wherein the slit opening 208 is sleeved over the protrusion 304. There is no exact line where the rim edge 306 begins and ends within the central space 303 of the platform 301, except that the central space 303 of the platform 301 essentially defines where the usable interfacing space of the platform 301 and fits within the internal hollow space of the second surrounding wall 201. The rim edge 306 on contrast, extends beyond the central space through the slit openings 208 to contact the first surrounding wall 101. Where the platform 301 comprises a central concave mesh, the point of attachment of the mesh to the edge of the platform 301 can define where the rim edge 304 begins and ends internally according to where the functional interfacing space begins and ends on the platform 301. The rim edge 306, according to this example, would serve a secondary function of holding the central interfacing piece of material in place and along the threaded column of the first surrounding wall 101. Depending on the symmetry of space between the threaded end 305 of the protrusion 304 and the threaded inner surface of the first surrounding wall, the minimum number of protrusion 304 necessary to enable this invention may vary in order to ensure the platform 301 remains in continual contact with the threaded inner surface 106 of the first surrounding wall 101.

The platform 301 and second surrounding wall 201 can also be operatively and moveably attached so as to be manufactured and viewed as a single piece. While shown in FIGS. 9-11 for a second embodiment and further described below, it should be understood that the first embodiment can include similar structure.

The platform 301 of this device can take many varieties of embodiments. The platform 301 interfaces and interact the most with the products held therein. As such, this particular element of the invention has mutable value and capability in its ability to change the form and manner of interaction with those products. The platform 301 can take a wide variety of embodiments to fit the variety of needs within the paradigm of this invention. The paradigm of this invention comprising a system wherein a product is placed inside a container, the container having a rotating adjustable base, and the product is manipulated therein.

The platform 301 in its simplest form can comprise a planar disc, functioning as an adjustable bottom base of a container. Food held thereon can simply be raised or lowered with the adjustment of the platform 301. If the container has a fixed base at its bottom, the planar disc platform 301 can be placed above material contained therein such that when the platform is rotated downward compressing the material, shaping and molding may occur.

Alternatively, the central area 303 can include a concave mesh for separation of solid material by size and gravity. In this case, the container would have a fixed bottom base and the platform 301 would be a separate adjustable element located centrally within the cavity of the container. This embodiment having a central concave mesh may have popular application in the self service food industry involving the food comprising solid and liquid products such as soups or stews. In these cases, the mesh would consolidate the solid food product from the liquid without complete separation of the two, allowing the user to find and scoop the solid products away from the liquid with minimal stifling, otherwise damaging the integrity of the solid material by traditional stir and scoop method.

In yet another embodiment, the tube includes two divided halves along its length that may be attached together and locked in place to form an enclosed tube. The platform 301 can include a planar central space with a central slicing element (i.e. metal wire or razors) with the sharp edge of the element facing at an angled planar direction and a slit to allow material to flow through said sharp edge to the opposite side of the platform 301. Dense material can be placed within the tube wherein the platform 301 would be rotated by the rotating key resulting in a spiral cut of the material therein. Once the cut is completed, the tube halves may be unlocked and opened to find a continuous spiral ribbon of material.

Yet another embodiment can include a solid planar platform 301 with the central area 303 having perforations of any type of cross sectional shape. As with the above razor embodiment, compression of the platform 301 against a soft dense material therein forces the material through the perforations, extruding noodle like ribbons with molded cross sectional shape in a spiral like extruded manner.

The platform 301 itself as it regards the shape of the central perimeter need not be circular so long as the protrusion rotates along a circular perimeter and the ends of the protrusion (defining the diameter or width of the rim of the platform) is in continual contact with the internal surface threading of the first surrounding wall to keep the platform in place at all times and allows it to rotate along the length of the column with the rotation of the rotating key.

According to FIG. 4, the device and system includes three core components. The first component is a first surrounding wall 402 that is threaded 408 in its inner surface 403, as shown and described above for FIG. 1. The second component is a second surrounding wall 404 with slit openings 405 as shown and described above for FIG. 2. The third component is a platform 406 with threaded protrusions 407 as shown and described above for FIG. 3. The system herein provides the three components wherein the slit openings 405 of the second surrounding wall 404 are sleeved over the protrusions 407 of the platform 406. These two components are nested within the first surrounding wall 402 wherein the protrusions 407 of the platform 406 are threaded into the matching threading 408 of the first surrounding wall 402. The second surrounding wall 404 is nested within and between the first surrounding wall 402 and the platform 406. By rotating or dialing the second surrounding wall 402 clockwise or counterclockwise, the slit opening 405 moves the protrusion 407 in the same direction, causing the platform to rotate along its threaded connection either upward or downward along the length of the container column. According to one embodiment of this invention as provided in the illustration of FIGS. 2 and 4, the slit opening 405 is cut all the way through the bottom end of the second surrounding wall 404.

The ideal or preferred embodiment of this invention would be in cylindrical form wherein both first 101 and second surrounding walls 201 are circular in shape to form two nested cylindrical tubes. This is an ideal embodiment because there would be no gaps or waste of space within the cavity between the three elements. Each element in this form would fit flushly against the internal surface of the other such that a maximum usable surface area is provided within the container and on the platform. Minimal use of material is required for each unit of available surface area in this embodiment. Lastly, the cylindrical feature of this embodiment is most space conserving and adaptable when sharing space with other devices or products on a given surface.

Whether or not the slit opening 405 is closed or open at the bottom end of the second surrounding wall 404 dictates number of steps of assembly, though not altering how it functions according to the claim. According to the embodiment of FIG. 4, the user would connect the threading of the platform 407 to the threading 408 of the first surrounding wall 402, sleeve the slit opening 405 over and through the protrusion 407 and finally rotate the second surrounding wall 404 to cause the platform 406 to move downward to a choice position within the container column. This is a three-step assembly process. Alternatively, the bottom end would be closed with the platform 404 permanently retained therein by the protrusions 407 loosely floating within the slotted slit opening 405. In this alternative example, the two piece unit would be placed overtop the first surrounding wall 402 and rotated to establish a threaded connection. This alternatively provides a two step assembly.

An alternative embodiment of the first surrounding wall 101' is shown in FIG. 5. A male pattern design 110' (such as protrusions or grooves) is included on a top portion 111' of the inner surface 103'. The purpose of the male pattern design 110' is to allow the container to hold its position under stressful weights. Clockwise rotation (or rotation in a first direction) has a smooth design to ease lifting of the platform 301'. The male pattern design 110' serves as a minimal locking mechanism only when rotating the key (i.e. second surrounding wall 201') counter clockwise or in a second direction. Otherwise, the first surrounding wall 101' can include any of the other features as describe above, indicated in FIG. 5, such as the hollow column 102', inner surface 103', hollow inner cavity 104', outer surface 105', threads 106', top end 107', and bottom end 108'.

An alternative embodiment of the second surrounding wall 201' is shown in FIG. 6. A female pattern design 210' (such as protrusions or grooves) is included on a bottom side 211' of the top end 206'. It is designed to sit on top of the male pattern design 110' of the container. In other words, the male pattern design 110' and the female pattern design 210' correspond such that they fit together and lock. The purpose of the female pattern design 201' is to allow the container to go up smoothly and have a minimal locking mechanism when going down and to allow heavier weights inside the container to be held strong. The second surrounding wall 201' can also include any of the other features described above, such as the wall surface 202', inner surface 203', outer surface 204', hollow cavity column 205', bottom end 207, and slit openings 208'.

Figure 7:
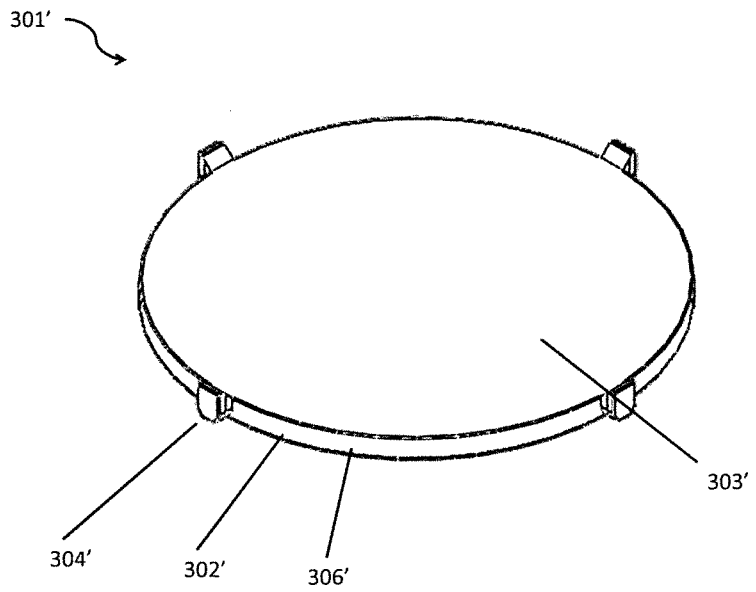
FIG. 7 is a top perspective view of an alternative embodiment of a platform.

An alternative embodiment of the platform 301' is shown in FIG. 7. Platform 301' is essentially the same as platform 301, being a planar piece of material 302' having a top and bottom surface, a central area 303', a rim edge 306' and one or more protrusions 304'. However, the protrusions 304' in this embodiment are smooth, i.e. there are no threads, and the surface 307' engages with (is flush with) the first surrounding wall 101' between the threads 106'. The protrusions 304' are large enough to fit between the threads 106' of the first surrounding wall 101' and travel around the inner surface 104' seamlessly.

The first surrounding wall 101', second surrounding wall 201', platform 301' fit together as in the above embodiment, with the added benefit of the second surrounding wall 201' being more stable within the first surrounding wall 101' due to the presence of the male 110' and female design patterns 210'.

Figure 9:
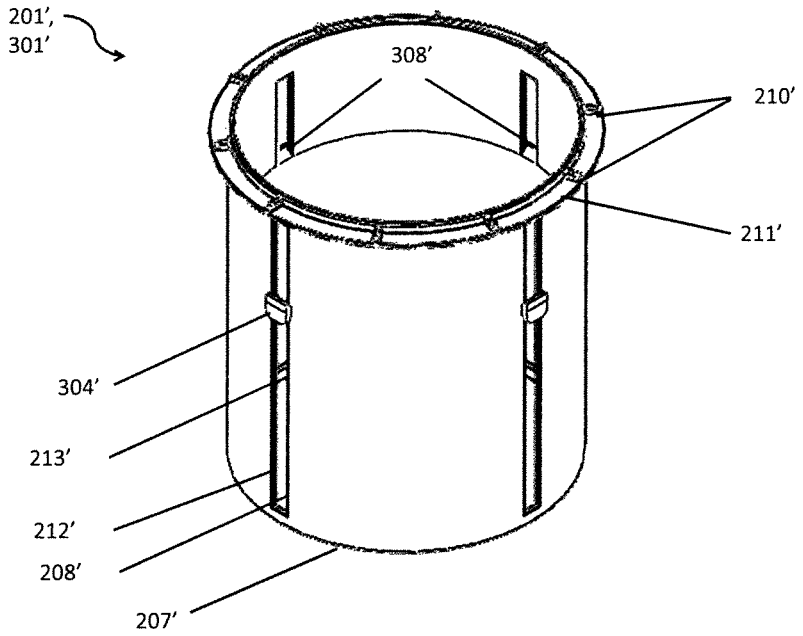
FIG. 9 is a top perspective view of an alternative embodiment of a second surrounding side wall having a platform attached.
Figure 10:
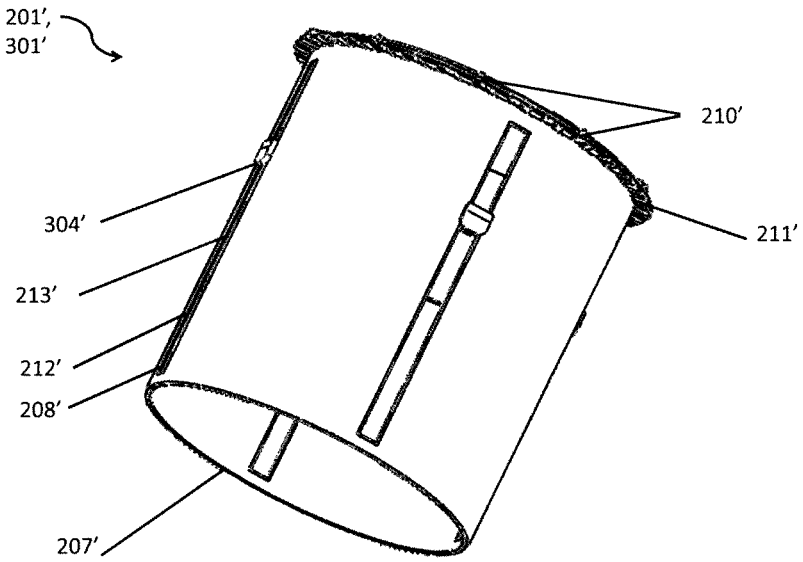
FIG. 10 is a side perspective view of an alternative embodiment of a second surrounding side wall having a platform attached.
Figure 11:
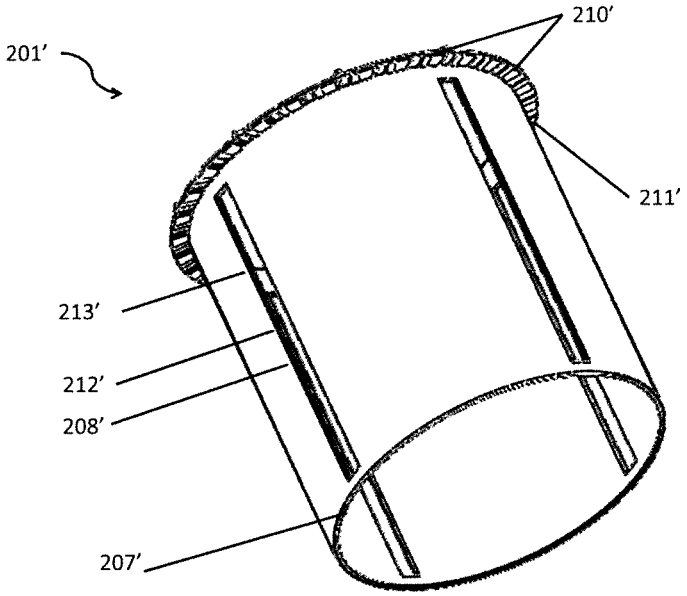
FIG. 11 is a side perspective view of an alternative embodiment of a second surrounding side wall showing tracks within the slits.

The platform 301' and second surrounding wall 201' can also be operatively and moveably attached so as to be manufactured and viewed as a single piece, as shown in FIGS. 9-11. The protrusions 304' can include rails 308' extending therefrom that fit within a track 212' on a side wall 213' of the slit openings 208' of the second surrounding wall 201'. The rails 308' can slide within the track 212' as the second surrounding wall 201' is turned or lifted as the protrusions 304' move along the threads 106' of the first surrounding wall 101', lifting the platform 301'. As described above, the second surrounding wall 201' can be closed at the bottom end 207' to prevent the platform 301' from coming apart from the second surrounding wall 201'. Alternatively, the track 212' can stop short of the bottom end 207' to prevent the platform 301' from coming apart from the second surrounding wall 201'.

Figure 8:
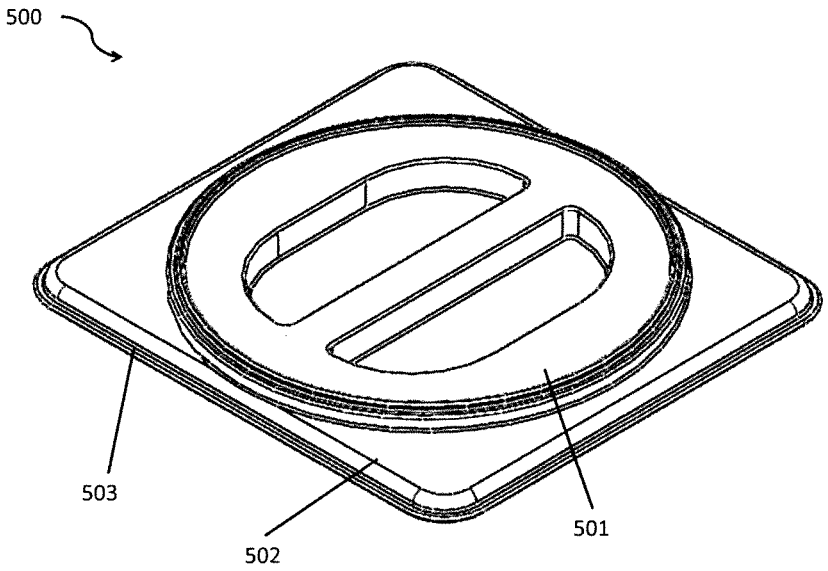
FIG. 8 is a top perspective view of a slotted lid.

A lid 500 is shown in FIG. 8 that can be used to cover the container device 400. The lid 500 can include a handle 501 of any suitable design raised from a top surface 502. The lid 500 can include a rim edge 503 that fits securely over the top end 107 of the first surrounding wall 101.

The method herein provides for a way to adjust a platform within a container by rotating handle or key as oppose to a lifting handle. The method of using the three part container system defined above includes raising or lowering a platform along the length of a container by rotating the second surrounding wall in either clockwise or counterclockwise direction around its cross sectional plane, causing the slit opening to move in the rotating direction of the second surrounding wall. This causes the protrusion, which is sleeved through the slit opening, to move in the rotating direction of the second surrounding wall. The platform is raised or lowered within the hollow cavity of the container along its length as the threading of the surrounding side edge of the protrusion travels along the threading of the internal surface of the first surrounding wall according to the rotation of the second surrounding wall. In the second embodiment, the method can further include the step of stabilizing the second surrounding wall on the first surrounding wall by use of the male and female pattern designs as described above.

This system of adjusting a base of a container by a rotating key element may be applied to more than simply a container in the restaurant business as discussed above. It may be an improvement and alternative method to other similar mechanized applications such as the traditional squeeze tube for cookie dough dispensers. Other embodiments may be in the area of separating materials through filter process wherein the container may be in the form of a cylindrical tube wherein one end is attached to a mesh cover. The second end of the cylinder tube may have an attachment to allow the user to easily rotate the second surrounding wall (rotating key), causing the base to move downward towards the first end and the mesh cover. As the materials held within are pushed forward, it is squeezed against the mesh cover, causing a separation of material held therein based on size or form. This type of application may be used in a wide variety of industry from food preparation to cleaning laundry wherein water is squeezed out of wet clothing. Alternatively, the central area of the platform comprises a concave mesh lining is attached to the rim edge such that as the platform moves upward along the cylinder column in vertical position, material is separated through said mesh lining by size and gravity.

Perhaps the most important quality of this adjustable base system 400 as it relates to the restaurant industry is the fact that each of the three elements of this device are all easily detachable and each having all exposed edges with no hidden grooves or enclosed hollow spaces. The platform 301 is simply a threaded disc. The first surrounding wall 101 is simply a threaded open container. The key element 201 is simply an open tube. Each element can be removed from each other and placed on a wash and dry rack of standard dish washing machines at restaurants, complying with FDA standard over food service regulations. The device can achieve regulatory sanitary standards by simple spray, soaking and drying method on an open platform without additional handling. This is a valuable quality for industries subject to higher regulatory standards concerning sanitation, allowing the standards to be met with minimal effort or handling. Unlike the prior art in the related industry as described above, each separate element of this device may be molded with no assembly of spare parts required. This enables a manufacturing process that can achieve a higher level of sanitary standard from start to finish including the packaging process.

The device and system of this invention is also ergonomically friendly in that the system can be intuitively understood by a person with little to no technical background. The rotating feature of this device eliminates need for a handle feature. A simple grooved tab or button may be located at the top surface of the second surrounding wall, accessible for a person's finger to touch and push to rotate. This feature may be helpful but not necessary to actuate the rotating key to adjust the platform. The rotating key solves the problem of handle protrusions in the space above the container which otherwise would get in the way where food is being served. It also solves another problem in that the entire surface area within the central area of the platform is fully available and the cavity space within the container is unobstructed by unwanted attachments or accessories.

Throughout this application, various publications, including United States patents, are referenced by author and year and patents by number. Full citations for the publications are listed below. The disclosures of these publications and patents in their entireties are hereby incorporated by reference into this application in order to more fully describe the state of the art to which this invention pertains.

The invention has been described in an illustrative manner, and it is to be understood that the terminology, which has been used is intended to be in the nature of words of description rather than of limitation.

Obviously, many modifications and variations of the present invention are possible in light of the above teachings. It is, therefore, to be understood that within the scope of the appended claims, the invention can be practiced otherwise than as specifically described.

What is claimed is:

1. A method of using an adjustable base container, including the steps of:

rotating a second surrounding wall in a first direction relative to a first surrounding wall;

moving at least one slit opening of said second surrounding wall in the first direction;

moving at least one protrusion on a platform in the first direction along a threaded inner surface of the first surrounding wall, thereby raising or lowering the platform; and stabilizing the second surrounding wall on the first surrounding wall, wherein a rim edge of the platform at its furthest edge is entirely in contact with the first and second surrounding wall.

2. The method of claim 1, wherein said stabilizing step is further defined as engaging a female pattern design on the second surrounding wall corresponding to and fitting a male pattern design on the first surrounding wall.

3. The method of claim 2, wherein the female pattern design is on a bottom side of a top end of the second surrounding wall and the male pattern design is on a top portion of an inner surface of the first surrounding wall.

4. The method of claim 3, wherein the male pattern design and the female pattern design fit together such that rotation of the second surrounding wall in the first direction results in eased lifting of the platform and rotation of said second surrounding wall in a second direction results in a lock.

5. The method of claim 1, wherein said moving at least one protrusion on a platform is further defined as engaging the protrusions with an inner surface of the first surrounding wall between threads.

6. The method of claim 1, wherein the slit openings extend completely through a bottom end of the second surrounding wall in an axial direction.

7. The method of claim 1, wherein the first surrounding wall is cylindrical in form and the second surrounding wall is cylindrical in form.

8. The method of claim 1, wherein a central space of the platform is chosen from the group consisting of a planar piece of material, solid material, a solid material with perforations, and mesh material.

9. The method of claim 1, further including the step of covering the adjustable base container with a lid.

10. The method of claim 1, wherein said moving at least one protrusion step further includes moving rails on the protrusions through a track on side walls at the slit openings of the second surrounding container.

* * * * *